US009243424B2

(12) United States Patent
Jin

(10) Patent No.: US 9,243,424 B2
(45) Date of Patent: Jan. 26, 2016

(54) HUB ASSEMBLY FOR A FOLDABLE TENT

(71) Applicant: Ki Ho Jin, Goyang (KR)

(72) Inventor: Ki Ho Jin, Goyang (KR)

( * ) Notice: Subject to any disclaimer, the term of this patent is extended or adjusted under 35 U.S.C. 154(b) by 0 days.

(21) Appl. No.: 14/146,189

(22) Filed: Jan. 2, 2014

(65) Prior Publication Data

US 2014/0109945 A1 Apr. 24, 2014

Related U.S. Application Data

(63) Continuation of application No. 13/560,021, filed on Jul. 27, 2012, now abandoned, which is a continuation-in-part of application No. 13/295,396, filed on Nov. 14, 2011, now Pat. No. 8,590,554.

(51) Int. Cl.

| | |
|---|---|
| ***E04H 15/36*** | (2006.01) |
| ***E04H 15/48*** | (2006.01) |
| ***E04H 15/42*** | (2006.01) |
| *E04H 15/14* | (2006.01) |

(52) U.S. Cl.

CPC ..... *E04H 15/36* (2013.01); *E04H 15/425* (2013.01); *E04H 15/48* (2013.01); *E04H 15/14* (2013.01)

(58) Field of Classification Search

USPC ..... 135/135, 120.3, 125, 136, 147, 93, 94, 135/114

See application file for complete search history.

(56) References Cited

U.S. PATENT DOCUMENTS

| | | | | |
|---|---|---|---|---|
| 14,655 A | | 4/1856 | Hartwell | |
| 58,283 A | | 9/1866 | Palmer | |
| 379,274 A | | 3/1888 | Hamilton | |
| 1,078,069 A | * | 11/1913 | Simons | 135/30 |
| 2,113,118 A | | 4/1938 | Pyati | |
| 2,306,706 A | | 12/1942 | Lucas | |
| 2,336,116 A | * | 12/1943 | Morando | 135/30 |
| 2,448,895 A | | 9/1948 | Lawrence | |
| 2,530,765 A | | 11/1950 | Greenup | |
| 2,555,220 A | | 5/1951 | Brown | |
| 2,731,972 A | | 1/1956 | Braun | |
| 2,948,287 A | | 8/1960 | Rupert | |
| 2,953,145 A | | 9/1960 | Moss et al. | |
| 2,962,034 A | | 11/1960 | Finlayson | |
| 2,984,249 A | | 5/1961 | Sears, Jr. et al. | |
| 3,054,413 A | | 9/1962 | Eshelman | |
| 3,177,882 A | * | 4/1965 | Militano | 135/28 |
| 3,333,373 A | | 8/1967 | Taylor et al. | |

(Continued)

FOREIGN PATENT DOCUMENTS

| | | |
|---|---|---|
| CA | 2022369 A1 | 2/1991 |
| CN | 1030790 C | 1/1996 |

(Continued)

*Primary Examiner* — Noah Chandler Hawk
(74) *Attorney, Agent, or Firm* — John H. Choi

(57) ABSTRACT

A hub assembly for a foldable tent includes a base and a plurality of slots formed on the base. Each slot is formed by a pair of side walls which are integrally formed on the base and includes a pivoting axis substantially normal between the corresponding pair of side walls. Poles are connected to opposing side walls of each corresponding slot for pivotal movement about the pivoting axis. In an open configuration of the tent inner ends of each of the poles engages the engaging surface of the base and is restricted from pivotal movement beyond the engaging surface, and in the closed configuration the inner ends of each pole is disengaged from the engaging surface of the base such that each pole is pivotable to a position substantially perpendicular to each corresponding engaging surface of the base.

8 Claims, 13 Drawing Sheets

(56) References Cited

U.S. PATENT DOCUMENTS

| | | | |
|---|---|---|---|
| 3,738,378 | A | 6/1973 | Williams |
| 3,810,482 | A | 5/1974 | Beavers |
| 3,929,146 | A | 12/1975 | Maiken |
| 4,077,417 | A | 3/1978 | Beavers |
| 4,148,332 | A | 4/1979 | Huddle |
| 4,201,237 | A | 5/1980 | Watts et al. |
| 4,280,521 | A | 7/1981 | Zeigler |
| 4,285,354 | A | 8/1981 | Beavers |
| 4,627,210 | A | 12/1986 | Beaulieu |
| 4,637,748 | A | 1/1987 | Beavers |
| 4,750,509 | A | 6/1988 | Kim |
| 4,787,182 | A | 11/1988 | Serge |
| 4,819,680 | A | 4/1989 | Beavers |
| 4,838,003 | A | 6/1989 | Zeigler |
| 4,941,499 | A | 7/1990 | Pelsue et al. |
| 4,971,090 | A | 11/1990 | Uhl |
| 5,195,551 | A | 3/1993 | Ju |
| 5,293,890 | A | 3/1994 | Park et al. |
| 5,328,286 | A | 7/1994 | Lee |
| 5,333,634 | A | 8/1994 | Taylor |
| 5,361,794 | A | 11/1994 | Brady |
| 5,423,341 | A | 6/1995 | Brady |
| 5,617,681 | A | 4/1997 | Lyons |
| 5,628,338 | A | 5/1997 | Stumbo |
| 5,634,483 | A | 6/1997 | Gwin |
| 5,666,986 | A | 9/1997 | Fox |
| 5,732,726 | A | 3/1998 | Lee |
| 5,797,695 | A | 8/1998 | Prusmack |
| 5,884,646 | A | 3/1999 | Ju |
| 5,943,837 | A | 8/1999 | Esser et al. |
| 6,021,795 | A | 2/2000 | Long et al. |
| 6,032,430 | A | 3/2000 | Soukup |
| 6,167,898 | B1 | 1/2001 | Larga et al. |
| 6,286,530 | B1 | 9/2001 | Hussey |
| 6,296,415 | B1 | 10/2001 | Johnson et al. |
| 6,516,823 | B1 | 2/2003 | Glover et al. |
| 6,591,571 | B2 | 7/2003 | Fritsche et al. |
| 6,604,844 | B2 | 8/2003 | Hussey |
| 6,666,223 | B2 | 12/2003 | Price et al. |
| 6,772,780 | B2 | 8/2004 | Price |
| 6,776,179 | B1 | 8/2004 | Chen |
| 6,854,476 | B1 | 2/2005 | Chai |
| 6,868,858 | B2 | 3/2005 | Suh |
| 6,874,519 | B2 | 4/2005 | Chiang |
| 6,892,744 | B2 | 5/2005 | Feldpausch et al. |
| 7,025,075 | B2 | 4/2006 | Suh |
| 7,040,585 | B2 | 5/2006 | Cheng et al. |
| 7,059,094 | B2 | 6/2006 | Yamawaki |
| D544,941 | S | 6/2007 | Rogers |
| 7,311,113 | B2 | 12/2007 | Suh |
| RE40,544 | E | 10/2008 | Suh |
| 7,481,235 | B2 | 1/2009 | Prusmack |
| 7,546,845 | B2 | 6/2009 | Prusmack |
| 2003/0005953 | A1 | 1/2003 | Erbetta et al. |
| 2007/0051399 | A1 | 3/2007 | Jung |
| 2007/0215192 | A1 | 9/2007 | Hoffman |

FOREIGN PATENT DOCUMENTS

| | | | |
|---|---|---|---|
| CN | 2506736 | Y | 8/2002 |
| CN | 2635827 | Y | 8/2004 |
| CN | 201129060 | Y | 10/2008 |
| CN | 202706658 | U | 1/2013 |
| CN | 202767622 | U | 3/2013 |
| GB | 2259927 | A | 3/1993 |
| GB | 2201703 | A | 9/1998 |

* cited by examiner

PRIOR ART

HUB ASSEMBLY FOR A FOLDABLE TENT

CROSS REFERENCES TO RELATED APPLICATIONS

This application is a continuation of U.S. patent application Ser. No. 13/560,021 filed on Jul. 27, 2012, which is a continuation-in-part of U.S. patent application Ser. No. 13/295,396 filed on Nov. 14, 2011, now U.S. Pat. No. 8,590,554, which are incorporated by reference in their entireties.

BACKGROUND OF THE INVENTION

The present invention relates to a foldable tent and more particularly to an improved hub assembly for foldable tents.

For novice campers, foldable tents are a popular alternative to conventional assemble-to-use tents. Foldable tents, which are commonly referred to as "instant tents," "one-touch tents" or "pop-up tents," are sold preassembled, making opening and closing of the tent easy and less time consuming. These tents are easily foldable because of the foldable and retractable nature of the poles, and the poles being pivotable within a central hub assembly.

Hub assemblies of foldable tents are known in the art and continue to develop and evolve. Recently, hub assemblies capable of functioning without additional supporting braces have been developed (i.e., a hub assembly with only a base and poles pivotally attached thereto) as described in the parent applications of the present application. However, several shortcomings were discovered through manufacture and use of those hub assemblies.

Hub assemblies are generally circular in shape and the slots formed on the hub assembly to house each pole are generally arranged radially such that each slot is spaced apart circumferentially. Because the hub assemblies are manufactured to a compact size, the space provided between adjacent slots is minimal. Therefore, when the hub assembly is manufactured with many poles (e.g., more than four poles), the hub assembly must be expanded radially outward to accommodate for additional slots, thus increasing manufacturing cost.

Hub assemblies in the prior art are also manufactured with fasteners for forming a pivoting axis for each pole. The fasteners, often metal screws, could be exposed through gaps formed between the poles and corresponding side walls, as well as portions of the screw which may protrude from either outer side of the side walls. Therefore, during factory assembly and/or opening and folding the tent by the user, the tent fabric could become damaged from contact with the metal screws. In addition, substantial manual labor is required to assemble each pole with the fasteners.

A need exists, therefore, for a hub assembly capable of housing many poles without significantly increasing the overall volume of the hub assembly. A need also exists for a hub assembly manufactured without hardware which could cause potential damage to other components of the tent. A further need exists for a hub assembly capable of easy assembly during the manufacturing process.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later. The present invention is intended to overcome at least the above-described disadvantages and to provide further improvements to instant tents in the prior art.

For achieving these objects, the present invention provides a hub assembly for opening and closing a tent between an open configuration and a closed configuration comprising: a substantially circular bottom support; a substantially cylindrical inner wall extending upwardly from a radially inner section of the bottom support, the inner wall being formed integrally with the bottom support; a plurality of slots, each slot spaced apart circumferentially along the bottom support and integrally formed therewith, each slot formed by a pair of opposing side walls extending upwardly from the bottom support and radially outwardly from the inner wall, each pair of side walls substantially parallel to each other, top ends of each pair of side walls being connected by a top support having top and bottom surfaces, bottom ends of each pair of side walls being unconnected such that an opening is formed under each top support, opposing side walls of each pair having matching indentations to define a pivoting axis substantially normal between the opposing pair of walls; a plurality of poles corresponding to the number of slots, each pole having an inner end and an outer end, opposing sides of the inner ends of each pole each having a substantially cylindrical pivot extension integrally extending therefrom, each opposing pivot extension pivotally connected to the opposing indentations of each corresponding slot; wherein in the open configuration the inner end of each pole engages a bottom surface of the top support of a corresponding slot such that the pole inner end is restricted from pivotal movement beyond said top support, and in the closed configuration the inner end of each pole is disengaged from the top support such that the poles are pivotable to a position substantially perpendicular to the top support.

In another aspect, the hub assembly of the present invention comprises a bottom support; a plurality of slots, each slot spaced apart circumferentially along the bottom support and integrally formed therewith, each slot formed by a pair of opposing side walls extending upwardly from the bottom support, top ends of each pair of side walls being connected by a top support having top and bottom surfaces, bottom ends of each pair of side walls being unconnected to each other such that an opening is formed under each top support; a plurality of poles corresponding to the number of slots, each pole having an inner end and an outer end, each pole inner end pivotally connected to opposing side walls of a corresponding slot; wherein in the open configuration the inner end of each pole engages a bottom surface of the top support of a corresponding slot such that the pole inner end is restricted from pivotal movement beyond said top support, and in the closed configuration the inner end of each pole is disengaged from the top support such that the poles are pivotable to a position substantially perpendicular to the top support.

In another aspect, the hub assembly of the present invention comprises a plurality of circumferentially spaced apart slots, each slot formed by a pair of opposing side walls, distal ends of said side walls having an engaging surface extending therebetween, opposing proximal ends of said side walls being unconnected to each other such that an opening is formed opposite the engaging surface, said opposing side walls having indentations substantially aligned with each other, each indentation positioned radially outside a radially outer free end of the engaging surface; and a plurality of poles, each pole having an inner end and an outer end, each pole inner end coupled to a corresponding slot, each pole inner end having a pivot extension extending therefrom;

wherein each pivot extension is secured to corresponding indentations such that each pole is pivotable from an open configuration wherein said pole inner end engages the engaging surface and a folded configuration wherein said pole is disengaged from the engaging surface and positioned substantially perpendicular thereto.

BRIEF DESCRIPTION OF THE DRAWINGS

To better understand the present invention, a more particular description of the invention will be rendered by reference to the appended drawings.

Figure 1:
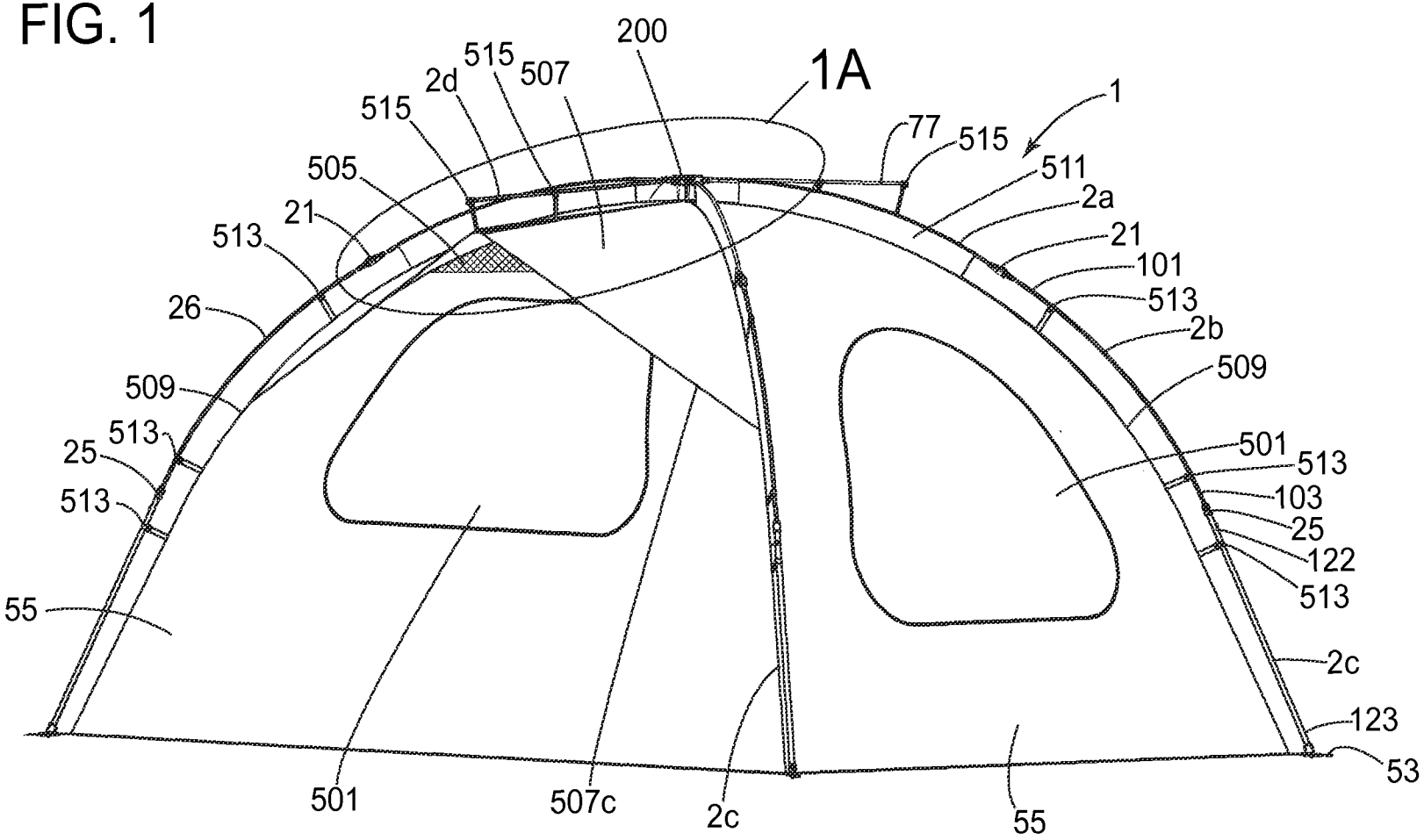
FIG. 1 is a side perspective view of the instant tent of the present invention in an open configuration.
Figure 1A:
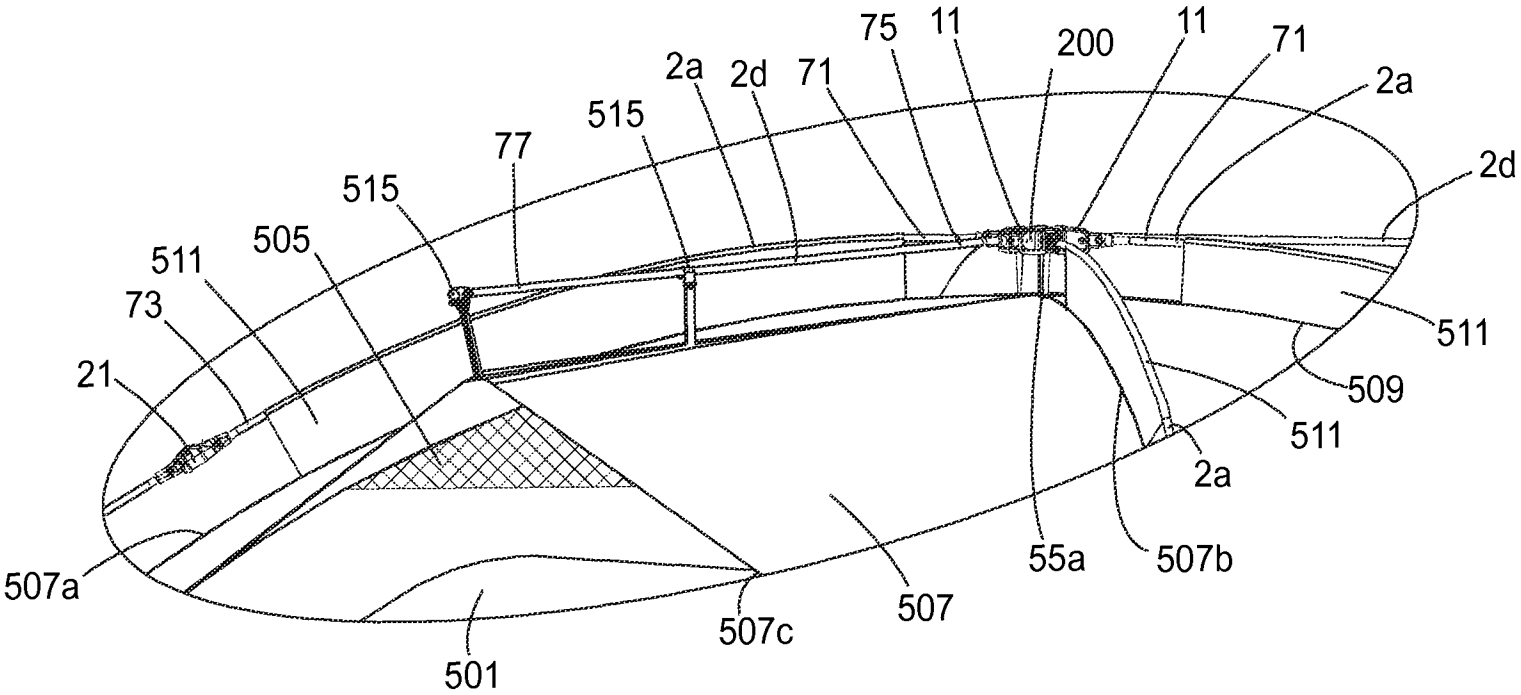
FIG. 1A is a partial perspective view of the top portion of instant tent of FIG. 1, which is denoted "1A" in FIG. 1.
Figure 2A:
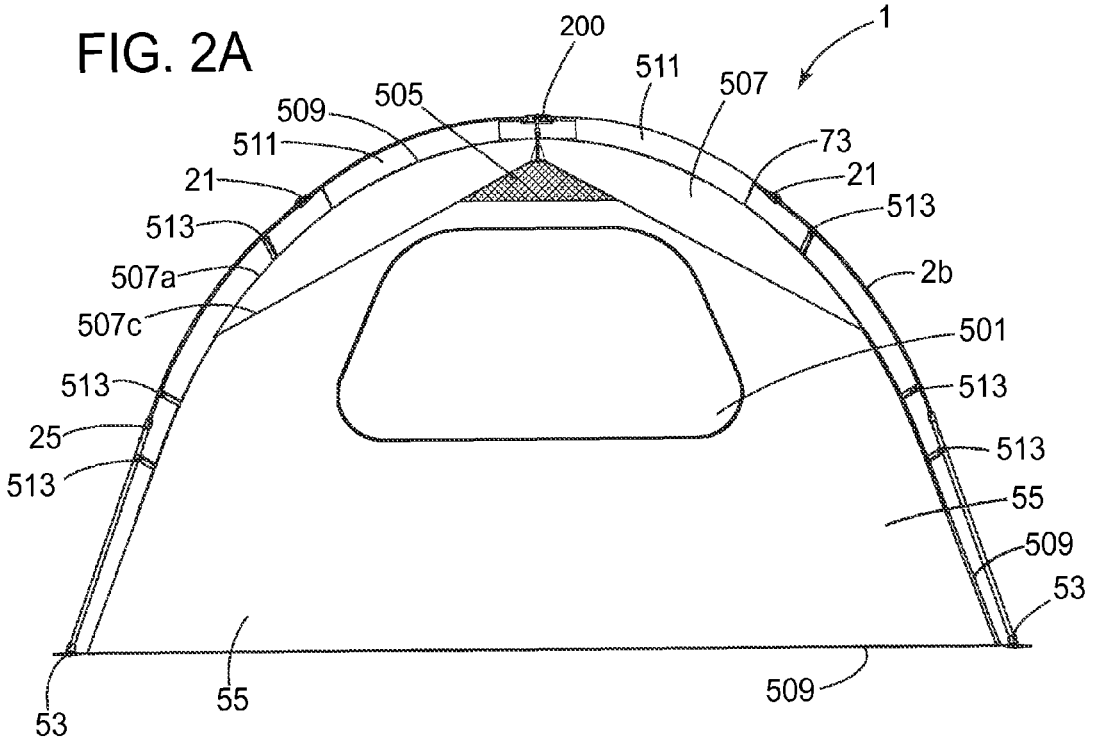
FIG. 2A is a side view of the instant tent shown in FIG. 1.
Figure 2B:
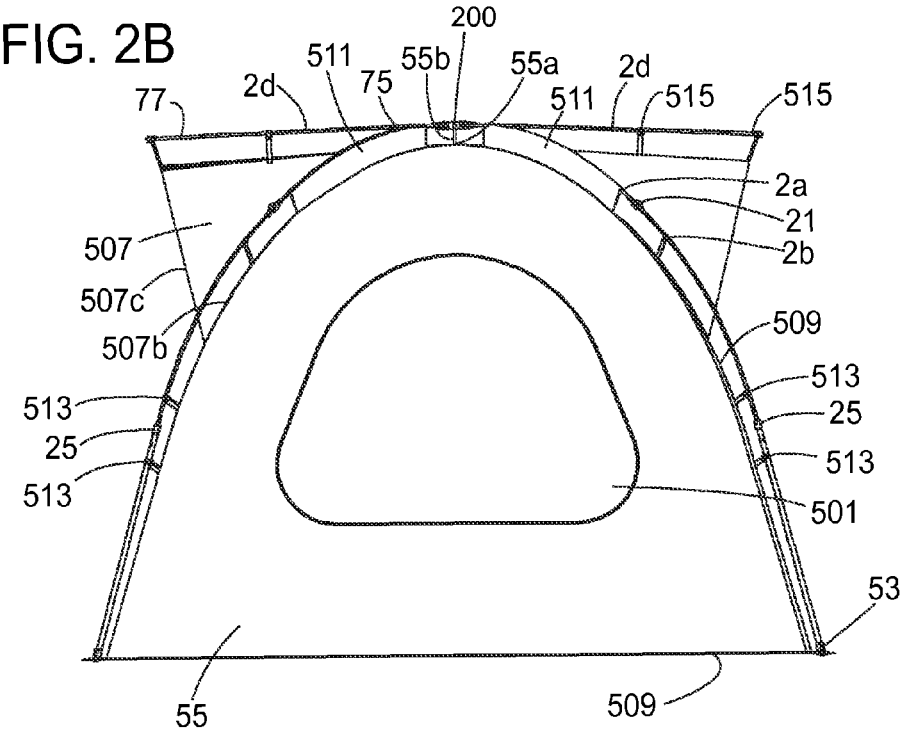
FIG. 2B is an alternate side view of the instant tent shown in FIG. 1.
Figure 3:
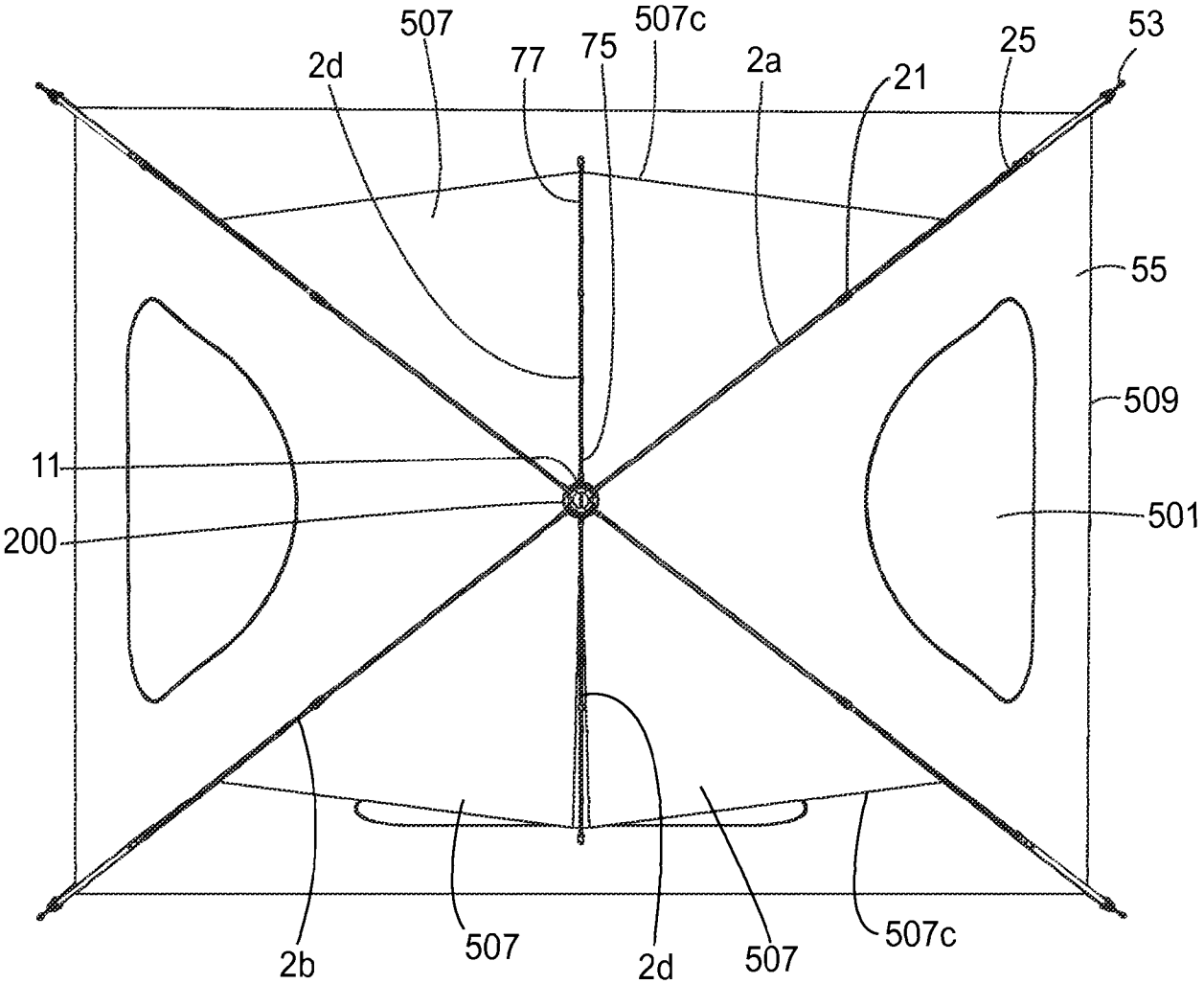
FIG. 3 is a top view of the instant tent shown in FIG. 1.

To facilitate an understanding of the invention, identical reference numerals and component descriptions have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

Figure 11A:
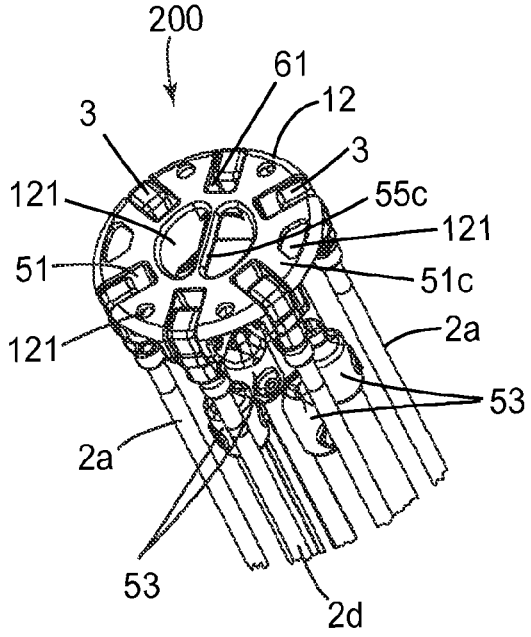
FIG. 11A is a partial bottom perspective view of the frame shown in FIG. 9 in a closed or folded configuration.
Figure 11B:
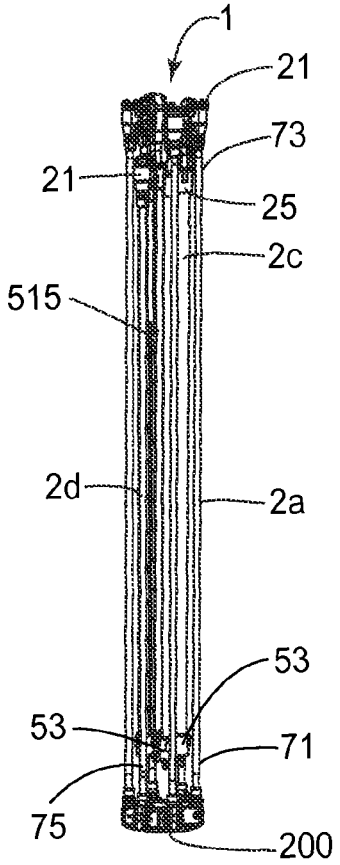
FIG. 11B is a side perspective view of the frame shown in FIG. 9 in a closed of folded configuration.

Referring to FIG. 1, a foldable tent 1 of the present invention is shown. The foldable tent is opened or erected to an open configuration as shown in FIG. 1, and folded or collapsed to a collapsed configuration as shown in FIG. 11B, without requiring assembly or disassembly of any parts.

Referring to FIGS. 1 and 8A-D, the foldable tent 1 is centrally supported by a hub 200 of the present invention. The hub 200 is circular but the shape of the hub 200 can be modified to other shapes including but not limited to square, hexagon or octagon shapes. The hub 200 is preferably formed of a tough, molded plastic but can also be constructed with other materials and methods without departing from the scope of the invention. The hub 200 can also be molded such that it includes voids 121, as shown in FIGS. 8A-D, to reduce the weight of the hub as well as manufacturing costs.

Figure 6:
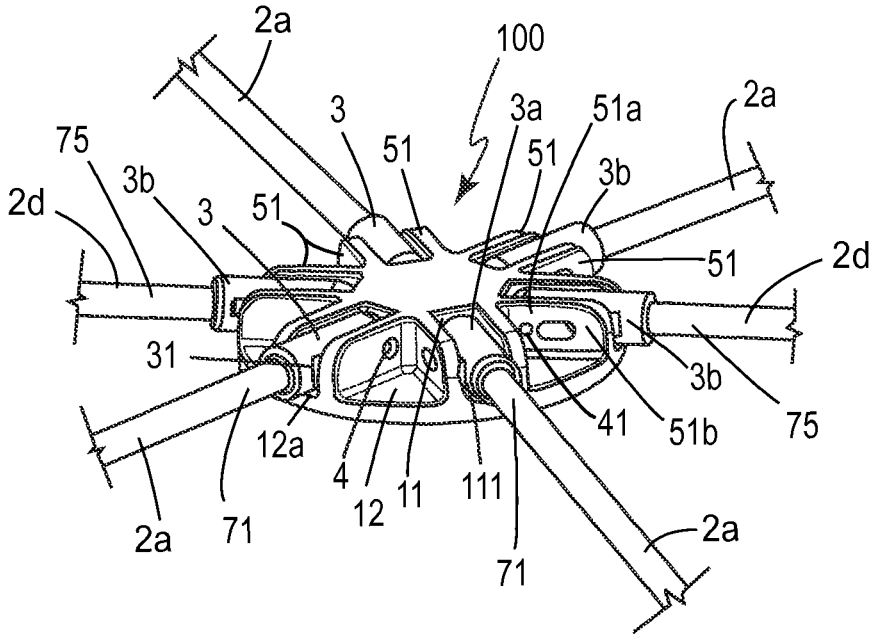
FIG. 6 is a partial perspective view of a hub assembly of the prior art.

Referring to FIG. 6, a hub 100 of the prior art comprises a stopper or base 12 having a top surface 12*a* and a bottom surface 12*b*. The base 12 includes a plurality of cabinets or slots 11 provided on the top surface of the base 12*a* and arranged in radial configuration. Each slot 11 is formed by a pair of adjacent walls 51, each having an inner end 51*a* and an outer end 51*b*, extending independently from the base top surface 12*a*. The walls of each slot 51 are also provided with pivoting holes 41 located at a radially inner end of the walls 51*a* and are substantially aligned. The base 12 uniformly extends radially and provides a surface below each entire slot 11.

Referring to FIGS. 8A-D, an embodiment of the connecting hub 200 of the present invention is shown. Here, the general structure of the hub 200 is similar to the hub of the prior art hub 100 with a few exceptions. First, the pivoting cabinets or slots 11 extend downward from the bottom surface of the base 12*b*. Second, the walls of each slot 51 have pivoting holes 41 located at a radially outer end of the walls (or vertical supports) 51*b* such that the holes 41 are substantially aligned. Third, the base portion 12 of each slot 11 is only partially extended radially outward such that an opening or void 61 extends radially outward through the rest of the slot 11 including below the pivoting holes of the walls 41. Fourth, a platform (or bottom support or horizontal support) 51*c* having voids 121 extends radially outward between lower portions of adjacent slots 11 to provide additional strength to the slots 11.

Referring to FIG. 1, in the preferred embodiment, the tent 1 further comprises four poles to form the frame of the tent, even though the tent 1 can operate with as few as three poles (see FIG. 7) and without limitation to the number of poles. While a variety of materials such as metal tubing, composite tubing (tubing made of resin impregnated fibers) or solid composite poles may be used, the poles preferably each comprise two fiberglass pole sections—a roof pole (or upper section) 2*a* and a middle section 2*b* of a leg pole; and a tubular steel lower section 2*c* of the leg pole, that are connectable together. The tent 1 can also be provided with any number of pole sections depending on the desired height of the tent in its open and collapsed configurations.

Referring to FIG. 1A and 8A-8D, each roof pole 2*a* has first and second ends 71, 73, and forms a roof portion of the tent 1. A substantially tubular pivoting cap 3, having first and second ends 3*a*, 3*b*, is secured to the first end of each roof pole 71. The caps 3 are constructed of a hard, molded plastic and provide the roof poles with additional protection from wear. The cap second end 3*b* is sufficiently secured onto the roof pole first end 71 by form-fit and/or adhesive but can also be secured via fastener 3*d*. It is preferred that the caps 3 are constructed such that the surface of the caps 3 contacting the slot walls 51 as well as the slot walls 51 are substantially flat while maintaining a close fit (see, e.g., FIG. 16). However, the caps 3 and slots 11 can be modified to other shapes and sizes to provide a close fit without departing from the spirit and scope of the present invention.

Figure 7:
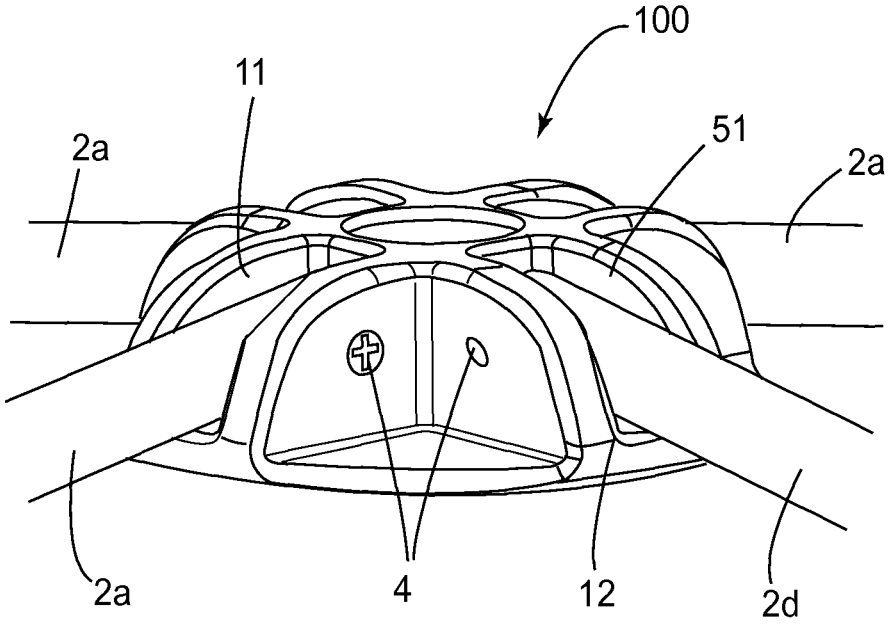
PRIOR ART FIG. 7
FIG. 7 is a partial perspective view of another hub assembly of the prior art.

Referring to FIGS. 8A-D, each cap 3 also has holes extending through opposing sides of the cap 3 such that the holes are substantially aligned. The aligned holes are located at or near the cap second end 3*b* and a fastener 4 extends through each cap as well as the pivoting holes 41 located on the outer end of each wall 51*b* to form a pivoting axis. Alternatively, the roof poles 2*a* can be directly connected to the slots 11 without a pivoting cap as shown in FIG. 7. The pivoting pin 4 can be any type of fastener such as a rivet, rod, bolt or screw.

Referring again to FIGS. 1 and 8A-D, the instant tent also includes eave poles 2*d*, having first and second ends 75, 77 pivotally connected to the slots 11 in the same manner as the roof poles 2*a* as described above. In the one embodiment, as shown in FIGS. 1, 3 and 8A-D, two eave poles 2*d* are included and each eave pole 2*d* is located on opposite sides of the base 12 between the roof poles 2*a* and extends radially outward at a length slightly shorter than the width of the tent 1. In an another embodiment, shown in FIGS. 4-5, four eave poles 2*d* are included. Thus, one skilled in the art will recognize that the number, length and location of the eave poles can vary. Moreover, the eave poles could have one of more extensions that are slidably or pivotally coupled, for example, by a pivoting joint 21 as shown in FIG. 9, to accommodate rain flies of any size or shape.

Figure 8A:
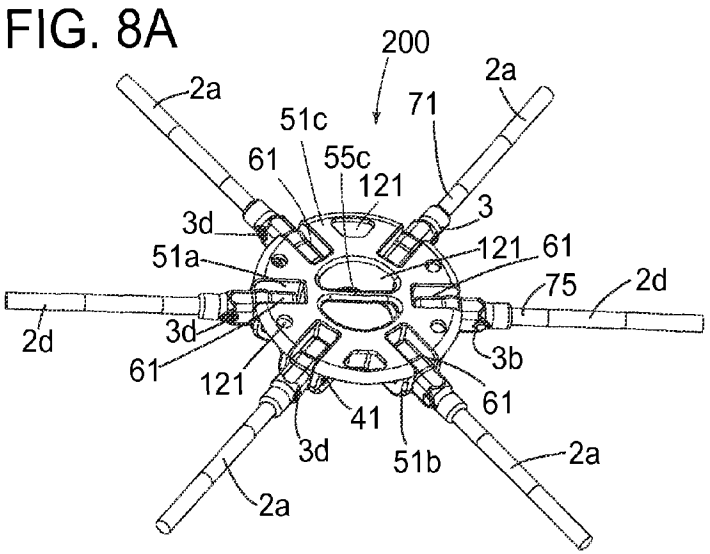
FIG. 8A is a bottom perspective view of an embodiment of a hub assembly of the present invention.
Figure 8B:
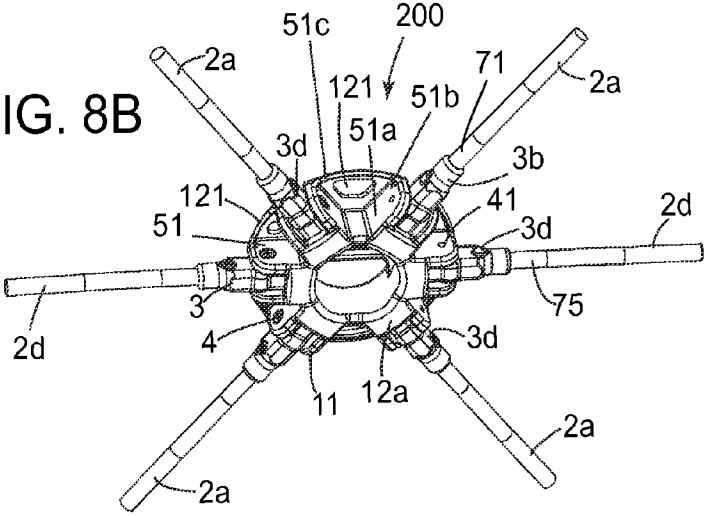
FIG. 8B is a top perspective view of the hub assembly shown in FIG. 8A.
Figure 8C:
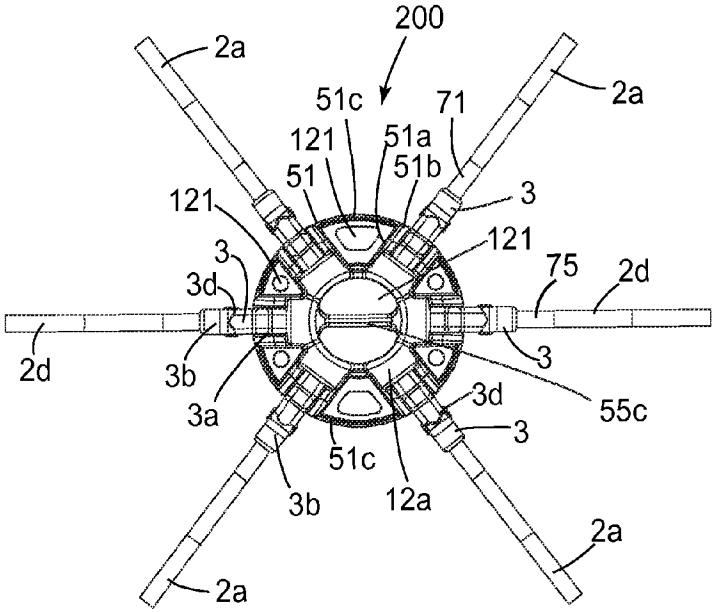
FIG. 8C is a top view of the hub assembly shown in FIG. 8A.
Figure 8D:
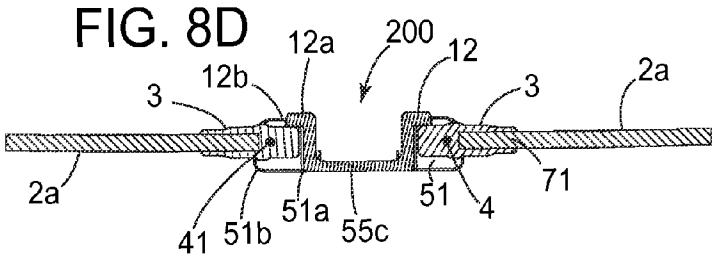
FIG. 8D is a sectional view of the hub assembly shown in FIG. 8A.

Referring to FIGS. 8A-D, the base 12 extends radially outward except that the base 12 does not extend above the radially outer portions of the slots 11 where the caps 3 are pivotally connected to the walls 51, thereby forming an opening or a void 61. Thus, in the open configuration, as shown in FIG. 8D, the bottom surface of the base 12*b* restricts the caps 3 and first ends of each the roof pole and eave pole 71, 75 from any upward pivotal movement beyond the bottom surface of the base 12*b*. As a result, the roof pole and eave pole first ends 71, 75 are secured in a substantially horizontal position or substantially parallel to the bottom surface of the base 12*b*. Referring to FIG. 11A, in the closed configuration, the opening 61 provided on the radially outer portions of the slots 11 allow the pole second ends 73, 77 to pivotally move upward while all or a substantial portion of the caps 3 located at the pole first ends 71, 75 remain below a horizontal plane extending from the top surface of the base 12*a* in the closed configuration.

Figure 9:
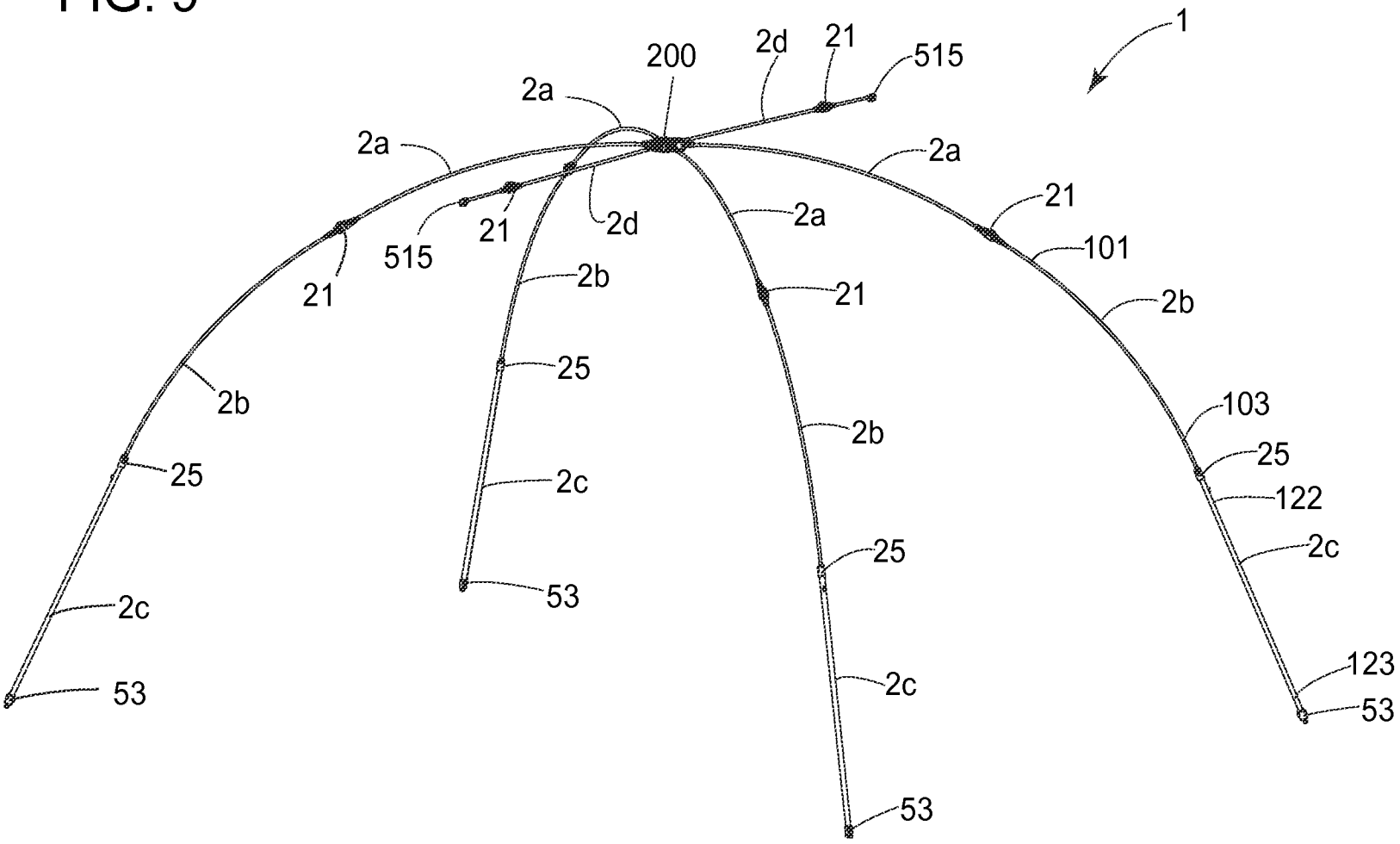
FIG. 9 is a perspective view of an alternative embodiment of a frame of the instant tent of the present invention.

Referring to FIGS. 1 and 9, the leg pole middle section 2*b* has a first end 101 and a second end 103. The roof pole 2*a* and the leg pole middle section 2*b* are pivotally coupled by a pivoting joint 21. In the preferred embodiment, the pivoting joint 21 is constructed as described in U.S. Pat. No. 7,942,159, which is incorporated by reference in its entirety, but the pivoting joint 21 can be constructed by any other conventional coupling means.

Figure 10:
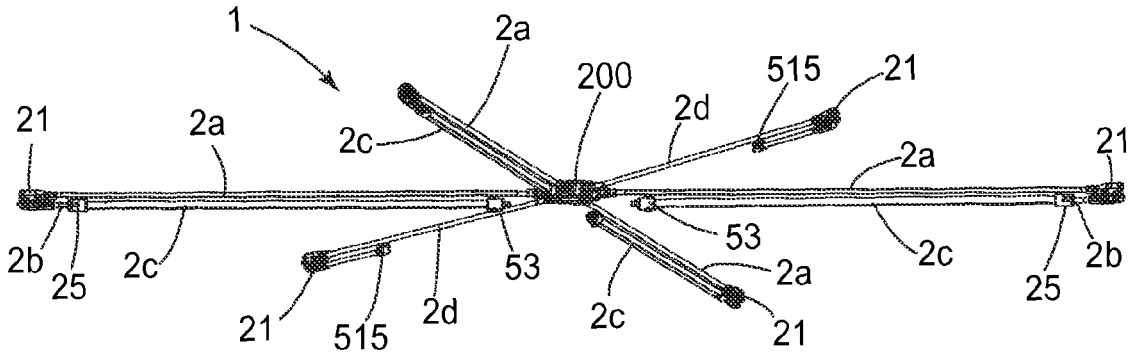
FIG. 10 is a side perspective view of the frame shown in FIG. 9 in a partially closed or folded configuration.

Referring again to FIGS. 1 and 9, each leg pole lower section 2*c* includes first and second ends 122, 123. The inner diameter of the lower section 2*c* is substantially similar to the outer diameter of the middle section 2*b* such that the middle section 2*b* is telescopically slidable within the lower section 2*c*. The second end of the middle section 103 is provided with a locking member 25. Each telescoping lower section 2*c* includes a spring loaded detent pin for indexing in apertures provided in each corresponding middle section 2*b* for locking the leg pole 2*b*, 2*c* in an extended position as shown in FIGS. 1 and 9, and depressing the detent pin to disengage the apertures to unlock and retract the leg pole lower section 2*c* as shown in FIGS. 10 and 11B. It is preferred that the length of the lower section 2*c* is less than or equal to the length of the middle section 2*b* such that when retracted substantially all of the middle section 2*b* is stored within the lower section 2*c*. The length of the retracted leg pole 2*b*, 2*c* is less than the distance between the top surface of the base 12*a* and the second end of the roof pole 73 so that the retracted leg pole 2*b*, 2*c* could be folded and stored above the base 12 as shown in FIG. 11B. Each extendable lower section 2*c* also preferably includes a foot 53 for engagement with the ground or other floor surface.

One of ordinary skill in the art will recognize that multiple spring loaded detent pin-aperture combinations could be included in each leg pole 2*b*, 2*c* such that the leg poles 2*b*, 2*c* could be adjusted to different lengths. One of ordinary skill in the art will also recognize that the pole sections 2*a*, 2*b*, 2*c* can also be coupled by other means, uniformly or in combination, including slidably, pivotably or by securing the pole sections 2*a*, 2*b*, 2*c* together by and elastic cord extending through the interior of the poles. It is also possible to couple multiple leg poles to a single roof pole, as described in China App. Pub. No. CN201474367U which is incorporated by reference in its entirety, to provide additional surface area for the floor of the tent as well as to provide additional support to the frame.

Referring to FIGS. 1-5, the tent 1 includes a tent canopy 55. In the preferred embodiment, the tent canopy 55 is water and flame resistant, and is a fabric constructed from materials such as cotton, polyester or nylon, or any combination thereof. The tent canopy 55 can also be constructed with heat reflecting material.

In the preferred embodiment, as shown in FIGS. 1-5, the tent canopy 55 is an enclosure which includes four canopy walls and a floor. The tent canopy preferably includes windows 501 on three canopy walls with each window 501 having two overlapping layers. The outside layer of each window is constructed of a permeable fabric such as mesh or the like and is sewn into the remaining fabric of the tent canopy 55. The permeable fabric allows outside air to enter the tent interior while also protecting the interior from bugs and debris. The inside layer is constructed of the water and flame resistant material described above, and is partially removable via a fastener such as a zipper or the like which is sewn into the remaining fabric of the tent canopy. The inside layer acts as a barrier between the interior of the tent and the outside such that when closed, the interior of the tent is protected from outside elements such as wind, rain or snow. Alternatively, the mesh outside layer of each window can be replaced with a transparent non-permeable material such as vinyl and the inside layer can be replaced with a shading device or curtain.

Figure 4:
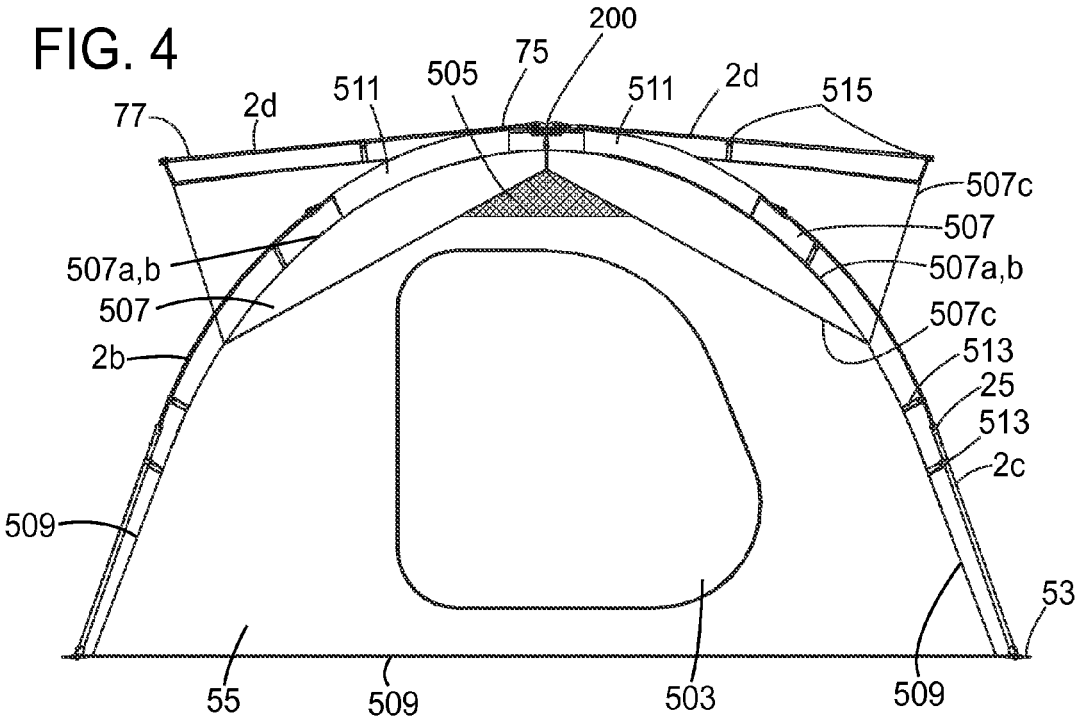
FIG. 4 is a side view of the instant tent of an alternative embodiment of the present invention.

The fourth side of the tent canopy is also equipped with a double layer of fabric identical to that of the three windows except that the mesh outer layer as well as the canopy fabric inner layer are both partially removable via fasteners thereby providing the tent with a door 503 for entering and exiting the tent, as shown in FIG. 4. One ordinarily skilled in the art will recognize that the number of sides as well as the number of windows and doors could vary depending on preference and design without departing from the scope of the present invention.

Figure 5:
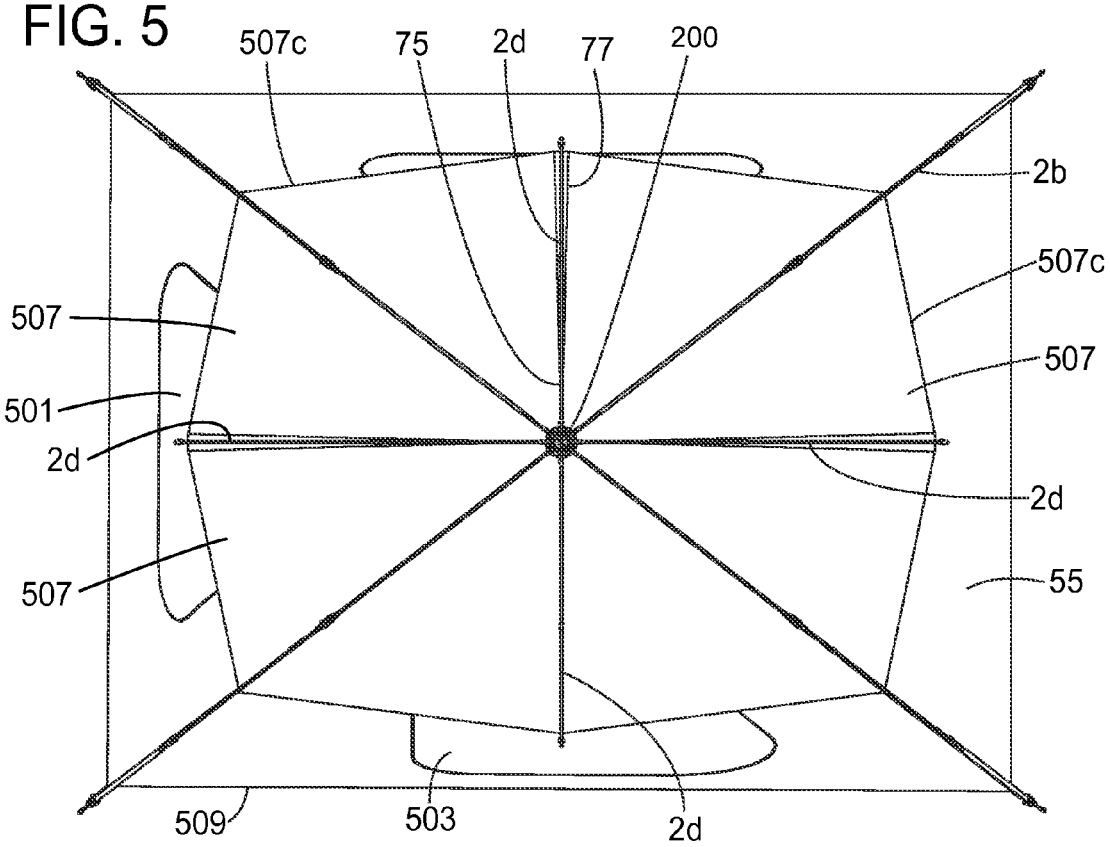
FIG. 5 is a top view of the instant tent shown in FIG. 4.

Referring to FIGS. 1-5, the top portion of the tent canopy 55 on each side of the tent 1 where the eave poles 2*d* are located also includes a permeable fabric 505 such as mesh. The permeable fabric improves ventilation for the tent interior while also protecting the interior from bugs and debris. In the preferred embodiment, the permeable section 505 is triangular and is located above the windows 501. One of ordinary skill in the art will recognize that a permeable fabric can be added to any number of sides of the tent and also take on other shapes and sizes without departing from the scope of the invention. For example, as shown in FIGS. 4-5, a permeable section can be included on all sides of the tent canopy provided that additional eave poles 2*d* and rain flies 507 (described in more detail below) are included on those sides.

As shown in FIGS. 1-5, the canopy 55 is connected to each pole 2*a*, 2*b*, 2*c* proximate seams 509 which join the canopy walls. A sleeve 511 extends from each seam 509 and is connected to the roof pole 2*a*. Three separate hooks 513 also extend from each seam 509 and are movably connected to the first and second ends of the middle section 101, 103 and at the first end of the lower section 121. In the preferred embodiment, the sleeve 511, instead of hooks, is provided on the roof pole 2*a* not only for aesthetic purposes but also because the length of the roof pole 2*a* remains constant throughout the opening and collapsing of the tent 1 and therefore a movable connection, i.e., a hook, is not required. The sleeve further provides the top portion of the canopy 55 with sufficient tension such that the top portion of the canopy does not sag. One with ordinary skill in the art will recognize that the various connecting methods as well as locations of the connections could vary without departing from the spirit and scope of the invention. An outer surface of the tent canopy at a top center location 55*a* can also be provided with a string 55*b* (see, e.g., FIG. 2B) attached to a bottom portion of the hub 55*c* (see, e.g., FIGS. 8A-D) to provide additional stability to the tent 1 as well as to ensure that the tent canopy 55 does not sag.

Referring again to FIGS. 1-5, the tent 1 also includes a rain fly 507 preferably constructed of the same material as the tent canopy 55 described above. The preferred embodiment includes two substantially triangular rain flies 507 on opposing sides of the tent 1. Each rain fly 507 has three perimeters 507*a*, 507*b*, 507*c*. Two of the three perimeters 507*a*, 507*b* are sewn into corresponding seams of the tent canopy 509 and culminate at the center of the tent canopy 55*a*. The remaining perimeter of each rain fly 507*c* is a free end which rests above the canopy wall. Each rain fly 507 is attached to a corresponding eave pole 2*d* along a line extending from the center of the tent 55*a* to a midpoint of the remaining perimeter 507*c* and are attached to each eave pole 2*d* at the midpoint of the perimeter 507*c* to provide further support for the rain fly 507 and also to provide a decline on each side of the rain fly 507 to eliminate the possibility of water or debris accumulating on top of the rain fly 507. The hook 515 located at the second end of the eave pole 77 is permanently attached so that the rain fly 507 is taut when the tent is opened without the user having to make any adjustments.

The rain fly 507 also sufficiently covers the permeable upper portion of the tent canopy 505 and protects the permeable portion 505 and the interior of the tent 1 from rain or snow and also provides shading. Furthermore, because there is sufficient space between the rain fly 507 and permeable portion 505, air from the exterior of the tent 1 can enter and exit the tent interior uninhibitedly to provide continuous ventilation. Furthermore, the windows 501 located beneath the rain flies 507 are provided with overhead protection as well. One of ordinary skill in the art will recognize that the size, shape and number of the rain flies could vary. For example, as shown in FIGS. 4-5, a rain fly can be added to all sides of the tent 1.

In operation, the collapsed tent 1 (see, e.g., FIG. 11B) is erected by pulling the roof poles 2*a*, leg poles 2*b*, 2*c* and eave poles 2*d* radially outward from the hub 1 (see FIG. 10) and then unfolding and extending the leg poles 2*b*, 2*c* radially outward (see FIG. 9). Only the frame of the tent is illustrated in these drawings to clearly show the instant tent 1 in the closed and partially closed configurations. As shown in FIGS. 8A-D, the first ends of each pole 71, 75 is secured within each corresponding slot 11 as the caps of each roof pole and eave pole 3 engages the bottom surface of the base 12*b* and the slot walls 51.

Referring to FIG. 1, each roof pole second end 73 and leg pole middle portion first end 101 are aligned and engaged as described in U.S. Pat. No. 7,942,159 or by any other conventional means. The leg pole lower section 2*c* is telescopically extended and locked to the middle section 2*b* via the locking member 25 by engaging the push pin with the aperture. The poles 2*a*, 2*b*, 2*c* are pulled radially outward to fully expand the tent canopy 55 and rain flies 507, the feet of the poles 53 are then fixed to the surface, and the tent 1 remains opened and securely erected. The tent 1 is further stabilized by downward forces exerted on the poles 2*a*, 2*b*, 2*c* by the tent canopy 55 through the various attachments (hooks 513 and sleeves 511) which tend to keep the poles 2*a*, 2*b*, 2*c* from pivoting upward.

To close the tent 1, the feet of the poles 53 are first disengaged from the supporting surface and the overall tension in the tent canopy 55 is decreased. Referring to FIG. 10, the lower sections of the poles 2*c* are telescopically retracted by disengaging the push pin and aperture of the locking mechanism 25. The roof pole 2*a* and leg pole middle portion 2*b* are pulled apart and each section is pivotally disengaged via the pivoting joint 21. The leg poles 2*b*, 2*c* and the tent canopy 55 are then folded radially inward toward the hub 100, 200. The poles are pivoted radially inward until the poles 2*a-d* (and canopy 55) are gathered above the hub 100, 200 in a compact closed configuration for convenient storage and transportability. As shown in FIG. 11A, the caps 3 are pivoted within the voids 61 of the base 12 such that the caps 3 remain within the voids 61 as shown in FIG. 11A and extend below the bottom surface of the base 12*b*.

Figure 12:
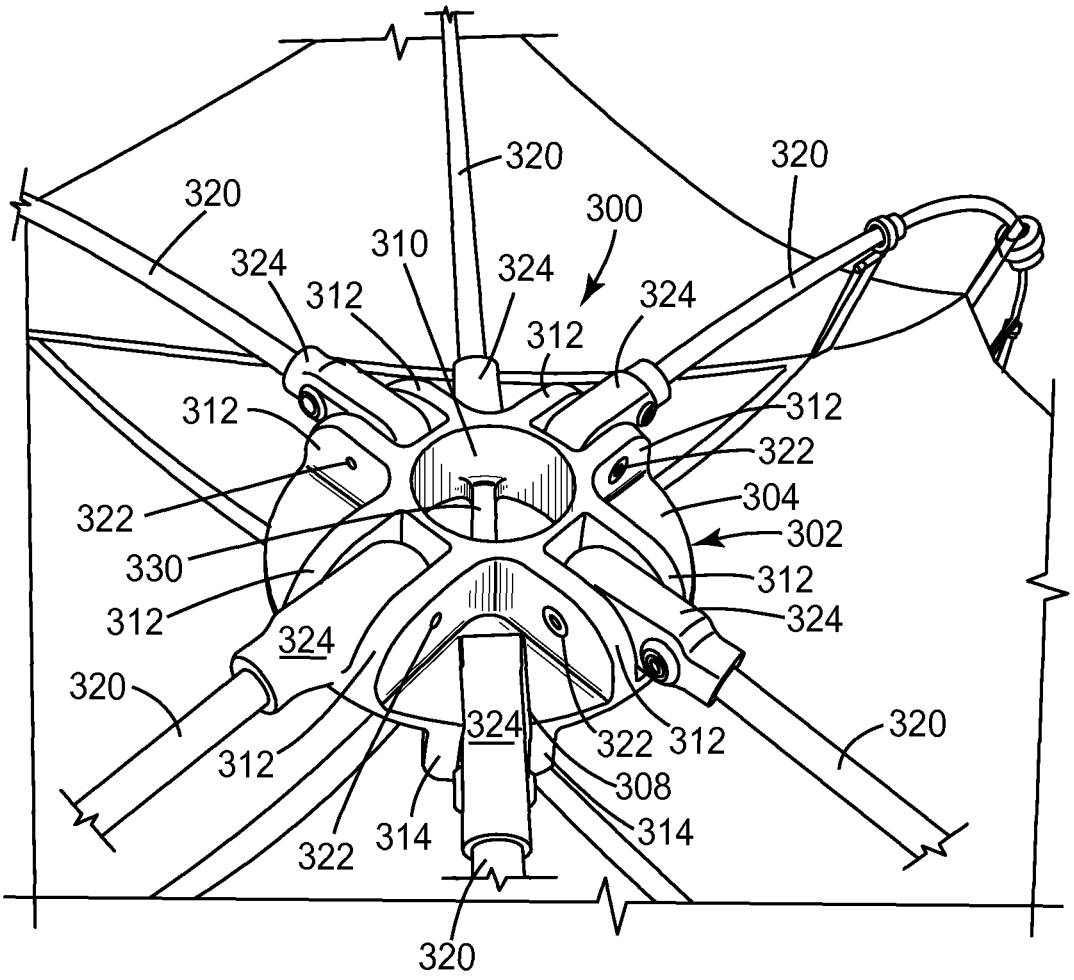
FIG. 12 is a top perspective view of another embodiment of a hub assembly of the present invention.
Figure 13:
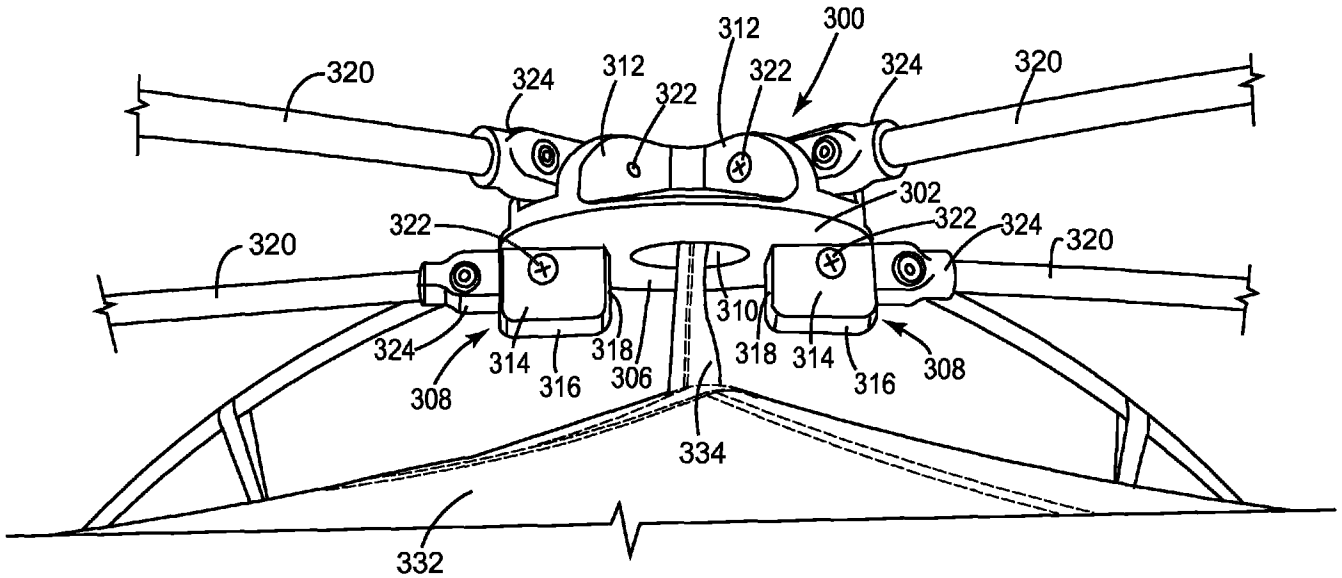
FIG. 13 is a bottom side perspective view of the hub assembly of FIG. 12.

Referring to FIGS. 12 and 13, another embodiment of a hub assembly 300 of the present invention is shown. The hub assembly 300 is similar to the hub assembly of the prior art hub 100 described above with a few differences. In this embodiment, the hub assembly 300 includes a substantially circular first bottom support or base 302 having a top surface 304 and a bottom surface 306. The first bottom support 302 includes openings 308 positioned along an outer periphery of the first bottom support 302. The hub assembly 300 is illustratively shown with two openings 308 but the number and locations of openings could vary without limitation. A substantially cylindrical first inner wall 310 extends upwardly from a radially inner section of the first bottom support 302 and is formed integrally with the first bottom support 302. In the present embodiment, the cylindrical first inner wall 310 forms a vertical void extending through the first bottom support 302. In this embodiment, an auxiliary support 330 extends diametrically through the void and is connected to an inner surface of the first inner wall 310 and is integrally formed therewith. The auxiliary support 330 is used to connect a canopy 332 of the tent with a string or strap 334 extending from the canopy 332, as shown in FIG. 13, to further secure the canopy 332 to the frame of the tent 1 and to prevent a center portion of the tent from sagging.

Referring again to FIGS. 12 and 13, the first bottom support 302 includes a first set of slots. Each slot of the first set is spaced apart circumferentially above the first bottom support 302 and integrally formed therewith. Each slot of the first set is formed by a pair of opposing, substantially parallel first side walls 312 extending upwardly from the first bottom support top surface 304 and radially outwardly from the first inner wall 310. The hub assembly 300 also includes a second set of slots. Each slot of the second set is positioned below the openings 308, which are located between adjacent slots of the first set, and is integrally formed therewith. Each slot of the second set is formed by a pair of substantially parallel opposing second side walls 314 extending downwardly from the first bottom support bottom surface 306 and radially outwardly to the outer periphery of the first bottom support 302. Each pair of second side walls 314 are connected by a second bottom support 316 having a top surface and a bottom surface. Radially inner ends of each pair of second side walls 314 are connected with a second inner wall 318 extending downwardly from the first bottom support bottom surface 306. Each second inner wall 318 is formed integrally with the first bottom support 302 and corresponding pair of second side walls 314. Thus, like each slot of the first set of slots, each slot of the second set is integrally formed by three sides to provide a solid foundation for housing each pole described below. The hub assembly 300 is illustratively shown with four equally spaced apart slots in the first set and two equally spaced apart slots in the second set, but the number and locations of the slots could vary. The positioning of the second set of slots below the first bottom support 302 instead of on the same plane as the first set of slots is critical to maintaining a smaller overall hub assembly. That is, due to the overall circular shape of hub assemblies, it is required that hub assemblies be manufactured with a larger surface area to accommodate for additional slots on the same plane. Thus, positioning the second set of slots below the first set of slots allows the hub assembly to remain compact while providing support for additional poles.

As shown in FIGS. 12 and 13, the hub assembly 300 also includes a plurality of poles 320 corresponding to the number of slots. Each pole 300 includes an inner end and an outer end with each pole inner end pivotally connected to each pair of first and second side walls 312, 314 for pivotal movement about a pivoting axis normal to the side walls 312, 314. In this embodiment, the pivoting axis is formed by a fastener 322, such as a screw, rivet or the like, extending through each respective pair of side walls and pole. However, the pivoting axis could be formed by laterally extending pins from the poles engaging with indentations on opposing side walls, as shown and described below with respect to a hub assembly of a fourth embodiment. Also, in this embodiment, each pole 320 inner end includes a cap 324 fixedly attached thereto, preferably by a fastener, such that the cap 324 is connected to the side walls 312, 314 to significantly decrease wear and tear on the pole 320 due to repeated pivotal movement of the poles 320. The portion of the cap 324 that forms the pivoting axis is preferably constructed of a solid, high-strength molded plastic and is capable of enduring the stresses associated with the use of the tent while in the open or pitched configuration. Other portions of the hub assembly 300 are constructed of the same material as well.

Referring to FIG. 13, in the present embodiment, the pivoting axes of the first set of slots are positioned radially inward relative to the pivoting axes of the second set of slots. This offset allows sufficient space above the bottom supports 302, 316 for folding and storing the poles 320 when the tent is in a closed or folded configuration. This is especially important for tents with many poles 320 as the tent in the closed or folded configuration must be sufficiently compact without having to force the components of the tent into the closed configuration as this may cause damage to the components.

In the open configuration, as shown for example in FIGS. 12 and 13, the inner end of each pole 320 engages the top surface (not shown) of each bottom support 302, 316 such that each pole 320 is restricted from pivotal movement beyond the respective bottom supports 302, 316. In the closed configuration, the inner ends of each pole 320 are disengaged from a corresponding bottom support 302, 316 such that each pole 320 is pivotable to a position substantially perpendicular to the bottom support 302, 316 and such that the inner ends of each pole 320 are positioned directly above corresponding bottom supports 302, 316 within each respective slot.

Figure 14:
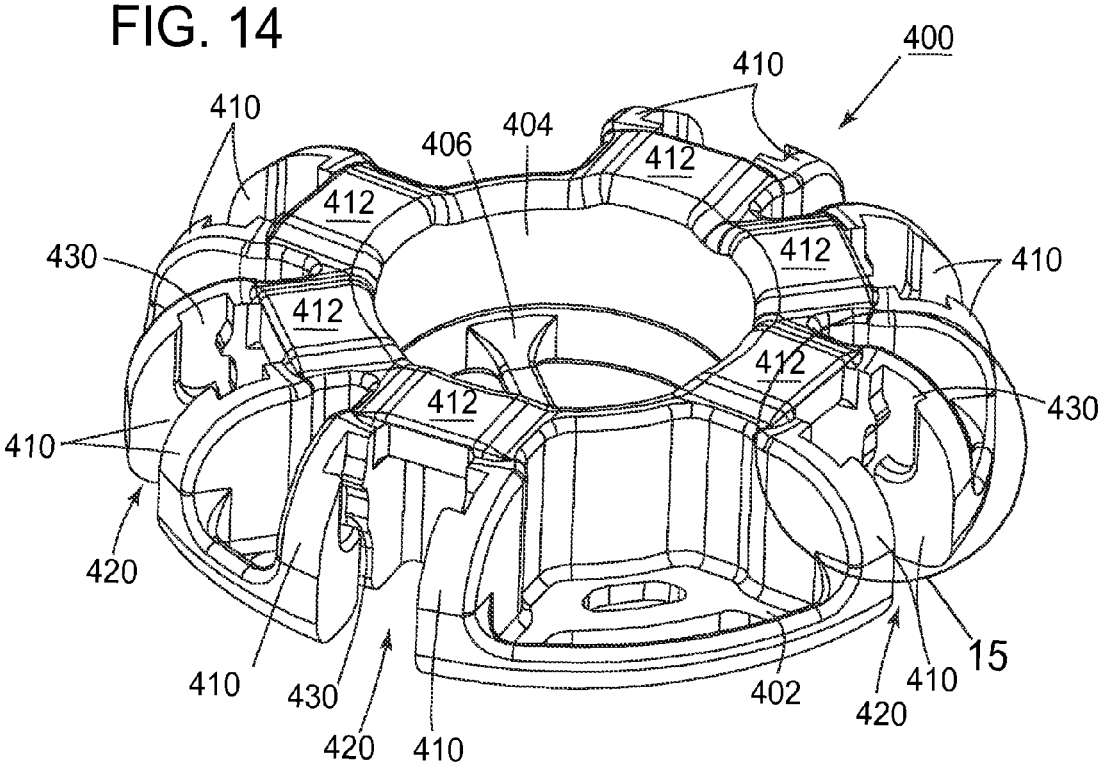
FIG. 14 is a top perspective view of another embodiment of a hub assembly of the present invention without the poles.
Figure 15:
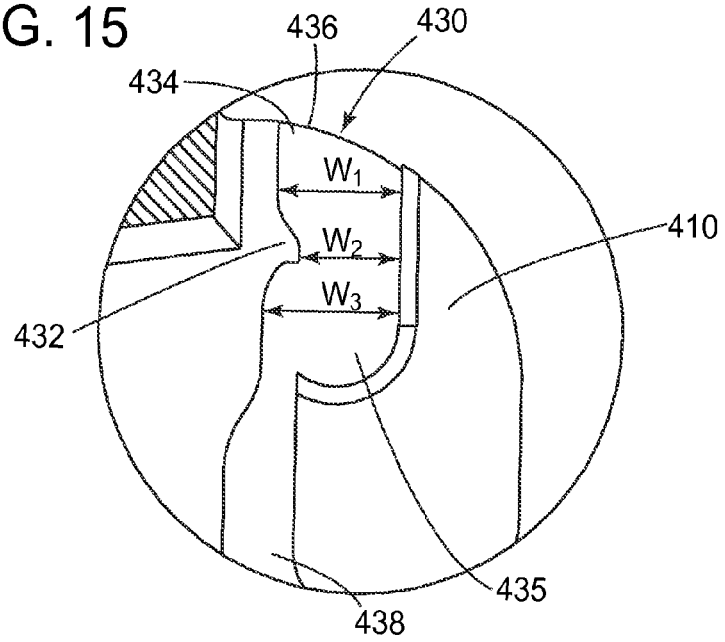
FIG. 15 is a side view of an indentation of a slot of the hub assembly of FIG. 14.
Figure 16:
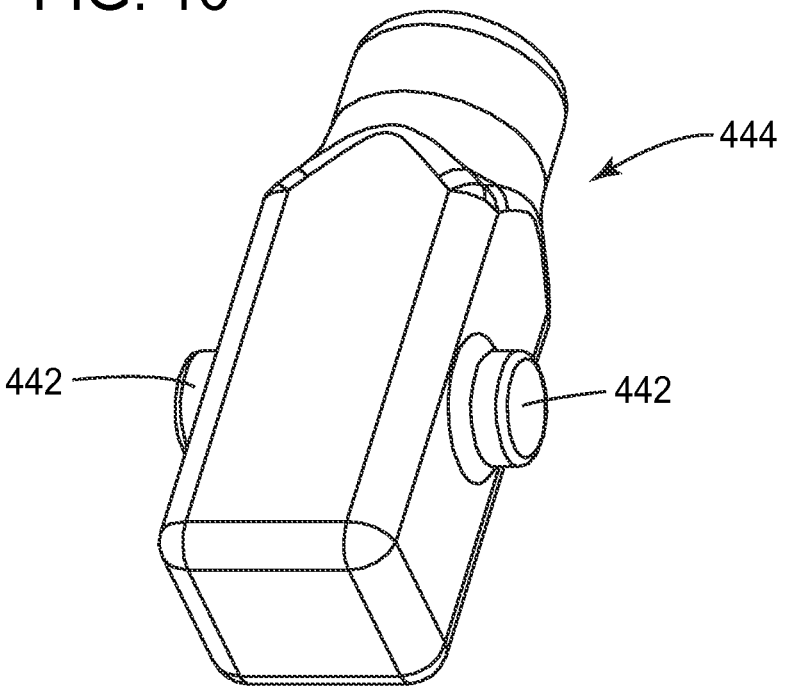
FIG. 16 is a perspective view of an inner end of a pole of the hub assembly of FIG. 14.
Figure 17:
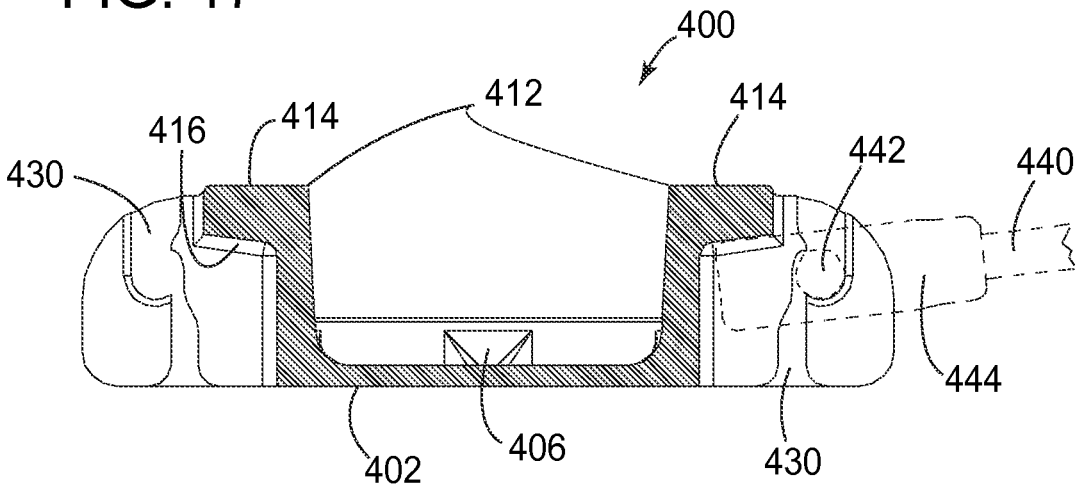
FIG. 17 is a sectional view of the hub assembly of FIG. 14 with a pole attached thereto.

Another embodiment of a hub assembly 400 of the present invention is shown in FIGS. 14-17. Referring to FIG. 14, the hub assembly 400 is similar to the hub assembly 200 described above but with a few differences. The hub assembly 400 includes a substantially circular bottom support 402 having a substantially cylindrical inner wall 404 extending upwardly from a radially inner section of the bottom support (or horizontal support) 402 and integrally formed therewith. In the present embodiment, an opening is formed in the radially inner section of the inner wall 404 and a diametrically extending auxiliary support 406 is integrally formed with the inner wall 404. The auxiliary support 406 is used to connect the tent canopy or rain fly with the hub assembly to prevent the upper center portion of the tent from sagging. Slots are integrally formed with the bottom support 402 and the inner wall 404. Each slot is spaced apart circumferentially along the bottom support 402 and each slot is formed by a pair of opposing side walls (or vertical support) 410 extending upwardly from the bottom support 402 and radially outwardly from the inner wall 404. Each pair of side walls 410 is substantially parallel to each other and top ends of each pair of side walls 410 are connected by a top support 412 having top and bottom surfaces 414, 416, as shown in FIG. 17. Bottom ends of each pair of side walls 410 are unconnected such that an opening 420 is formed under each top support 412. In the present embodiment, each side wall 410 extends radially outwardly beyond a corresponding top support 412. Opposing side walls 410 of each pair also include matching indentations 430 to define a pivoting axis substantially normal between the opposing pair of walls 410.

Referring to FIGS. 16 and 17, the hub assembly 400 includes a plurality of poles 440 corresponding to the number of slots. Each pole 440 includes an inner end and an outer end, and opposing sides of the inner ends of each pole each includes a substantially cylindrical pivot extension 442 integrally extending therefrom. Each opposing pivot extension 442 is pivotally connected to the opposing indentations 430 of each corresponding slot. In the present embodiment, each pole 440 inner end includes a cap 444 fixedly attached thereto, preferably by a fastener, such that the cap 444 is connected to the side walls 410 to significantly decrease wear and tear on the pole 440 due to repeated pivotal movement of the poles 440. The pivot extensions 442 are integral the cap 444. The cap 444 is preferably constructed of a solid, high-strength molded plastic and is capable of enduring the stresses associated with the use of the tent, especially when the tent is in the open or pitched configuration. The hub portion of the hub assembly is also constructed of the same material to endure similar stresses exerted through the use of the tent.

Referring to FIG. 15, each indentation 430 is disposed on each side wall 410 substantially perpendicular to a corresponding top support 412 and extends the entire length of the side wall 410. Each indentation 430 also includes a ridge 432. An upper channel 434 is formed between the side wall upper end 436 and the ridge 432 with the width of the upper channel $W_1$ being greater than or equal to the diameter of each pivot extension 442. A lower channel 435 is formed between the ridge 432 and a lower end of the side wall 438. The width of the lower channel $W_3$ is substantially similar to the diameter of each pivot extension 442. The width of the indentation 430 at an apex of the ridge $W_2$ is slightly less than the diameter of each pivot extension 442 such that during factory assembly each pivot extension 442 is inserted through the upper channel 434, snap-fit past the apex of the ridge 432 and secured within the lower channel 435 for pivotal movement therein. The utilization of integral plastic pivot extension 442 and indentations 430 instead of traditional metal fasteners drastically reduces the manufacturing cost by allowing faster assembly of the tent and lower material cost. This configuration also prevents possible damage to the tent fabric of the tent during assembly as well as use due to the tent fabric being tangled with the threads of the fastener and/or portions of the fastener protruding from the slots.

In the open configuration, the inner end of each pole 444 engages a bottom surface of the top support 416 of a corresponding slot such that the pole inner end 444 is restricted from pivotal movement beyond the top support bottom surface 416, as shown in FIG. 17 (and FIGS. 8A-8D). In the closed configuration, the inner end of each pole 444 is disengaged from the top support 412 such that the poles 440 are pivotable to a position substantially perpendicular to the top support 412, as shown for example in FIG. 11A.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A hub assembly for a tent comprising:

a plurality of circumferentially spaced apart slots, each slot formed by a pair of opposing side walls, distal ends of said side walls having an engaging surface extending therebetween, opposing proximal ends of said side walls being unconnected to each other such that an opening is formed opposite the engaging surface, said opposing side walls having indentations substantially aligned with each other, each indentation positioned radially outside a radially outer free end of the engaging surface; and a plurality of poles, each pole having an inner end and an outer end, each pole inner end coupled to a corresponding slot, each pole inner end having a pivot extension extending therefrom;

wherein each indentation comprises:

a ridge;

an upper channel between the side wall upper end and the ridge, the width of the upper channel being greater than the diameter of each pivot extension;

a lower channel between the ridge and a lower end of the side wall, the width of the lower channel being substantially similar to the diameter of each pivot extension; and a space defining the width of the indentation at an apex of the ridge, the space being slightly less than the diameter of each pivot extension such that each pivot extension is inserted through the upper channel and the apex of the ridge and secured within the lower channel;

wherein each pivot extension is secured to corresponding indentations such that each pole is pivotable from an open configuration wherein said pole inner end engages the engaging surface and a folded configuration wherein said pole inner end is disengaged from the engaging surface and pivoted downward from the engaging surface to a position substantially perpendicular thereto.

2. The hub assembly of claim 1, wherein each upper channel is substantially circular.

3. The hub assembly of claim 1, wherein each indentation extends from an upper end of the side wall to a mid portion of the side wall.

4. The hub assembly of claim 1, wherein the pivot extensions are substantially cylindrical.

5. The hub assembly of claim 1, wherein the engaging surface is positioned at upper ends of the side walls.

6. A hub assembly for a tent, the hub assembly comprising:

a substantially horizontal support;

a plurality of substantially vertical supports extending from the horizontal support; and a plurality of poles, each pole pivotally coupled to a corresponding vertical support;

wherein one of the vertical support and pole includes one of a pivoting extension and a matching indentation, another one of the vertical support and pole includes another one of the pivoting extension and the matching indentation, the pivot extension coupled to the matching indentation;

wherein each indentation comprises:

a ridge;

an upper channel between the vertical support upper end and the ridge, the width of the upper channel being greater than the diameter of each pivot extension;

a lower channel between the ridge and a lower end of the vertical support, the width of the lower channel being substantially similar to the diameter of each pivot extension; and a space defining the width of the indentation at an apex of the ridge, the space being slightly less than the diameter of each pivot extension such that each pivot extension is inserted through the upper channel and the apex of the ridge and secured within the lower channel;

wherein each pole is pivotable from an open configuration wherein said pole is substantially below the horizontal support and a folded configuration wherein said pole is substantially above the horizontal support.

7. The hub assembly of claim 6, wherein in the open configuration each pole engages the horizontal support.

8. The hub assembly of claim 6, wherein in the folded configuration each pole disengages the horizontal support.

* * * * *